US005172492A

United States Patent [19]

Peterson et al.

[11] Patent Number: 5,172,492

[45] Date of Patent: Dec. 22, 1992

[54] BATCH-TYPE DRYER

[75] Inventors: Thomas W. Peterson, South Haven; John W. Vanden Bos, Holland; David Mc Leod, Roosevelt Park, all of Mich.

[73] Assignee: JWI, Inc., Mich.

[21] Appl. No.: 423,641

[22] Filed: Oct. 18, 1989

Related U.S. Application Data

[63] Continuation of Ser. No. 267,997, Nov. 4, 1988, abandoned.

[51] Int. Cl.[5] ..... F26B 11/12

[52] U.S. Cl. ..... 34/179; 34/243 R

[58] Field of Search ..... 34/179, 183, 108, 180, 34/166

[56] References Cited

U.S. PATENT DOCUMENTS

| | | | |
|---|---|---|---|
| 156,321 | 10/1874 | Webber . | |
| 474,568 | 5/1892 | Weller . | |
| 746,664 | 12/1903 | Bourdeau . | |
| 1,132,421 | 3/1915 | Anderson . | |
| 1,350,541 | 8/1920 | Booth | 34/179 |
| 2,320,469 | 6/1943 | Rasmussen . | |
| 3,138,167 | 6/1964 | Fisher . | |
| 3,426,838 | 2/1969 | Onarheim . | |
| 3,678,596 | 7/1972 | Kubo . | |
| 4,019,722 | 4/1977 | Shohet . | |
| 4,273,732 | 6/1981 | Roediger . | |
| 4,276,701 | 7/1981 | Takacs et al. . | |
| 4,437,767 | 3/1984 | Hargis . | |
| 4,469,445 | 9/1984 | Wurtz . | |
| 4,472,060 | 9/1984 | Hargis . | |
| 4,622,152 | 11/1986 | Resing et al. . | |
| 4,745,691 | 5/1988 | Bradbury . | |
| 4,750,274 | 6/1988 | Erdman, Jr. et al. . | |
| 4,761,897 | 8/1988 | Tazaki et al. . | |

*Primary Examiner*—Henry A. Bennett

*Attorney, Agent, or Firm*—Flynn, Thiel, Boutell & Tanis

[57] ABSTRACT

A batch-type dryer, such as for sludge, having a generally upwardly-opening channel-like drying chamber which is closed at opposite ends. The chamber is defined by a generally U-shaped sidewall having an arcuate bottom portion generated about a radius so as to define a generally semi-cylindrical configuration. The edges of this semi-cylindrical bottom wall are joined to straight sidewall parts which project upwardly in generally parallel relationship. An auger-type rotor extends axially along the bottom of the chamber to agitate the material therein. A heat exchanger is associated with and extends around at least the arcuate bottom wall of the chamber. The U-shaped wall of the chamber has the central upwardly-extending plane thereof disposed at a selected angle, preferably about 30°, relative to the vertical so that the material, when the agitator rotates, remains in intimate heat-transfer contact with the arcuate bottom wall over substantially the full 180° extent thereof.

14 Claims, 4 Drawing Sheets

BATCH-TYPE DRYER

This application is a continuation of U.S. Ser. No. 07/267,997, filed Nov. 4, 1988, now abandoned.

This invention relates to an improved batch-type dryer which is particularly desirable for drying sludge, such as metal hydroxide sludge, paint sludge, oily waste, and water laden semi-solids.

BACKGROUND OF THE INVENTION

One known batch-type dryer which is promoted for drying sludge, specifically metal hydroxide sludge, employs an upwardly-opening channel-like drying chamber having an auger rotatably supported therein for agitating the sludge during the drying process. This drying chamber is defined by a generally U-shaped sidewall which opens upwardly and is closed at opposite ends. This sidewall has a bottom wall part which is of an arcuate configuration generated through an angle of about 180°, the center of which also defines the rotational axis for the elongate mixing auger. The arcuate bottom wall, after extending through this 180° angle, integrally joins to generally parallel sidewalls which project upwardly in a vertical direction. The sidewalls at their upper ends define a top opening which is disposed substantially within a horizontal plane, which opening permits material to be deposited into the drying chamber. The mixing auger has blades which run in close relationship to the arcuate bottom wall part so as to effectively wipe the sludge from the wall and effect agitation thereof. A steam jacket extends around solely the arcuate bottom wall part to effect heat transfer through the wall to effect drying of the sludge. This general arrangement is diagrammatically illustrated by FIG. 6.

With this prior art dryer, and as is typical with dryers of this general type, a batch of wet material (specifically sludge) is deposited into the dryer chamber so as to fill the chamber up to about the horizontal plane passing through the rotational axis of the agitator (the plane 35' in FIG. 6), whereby the material substantially fills the arcuate bottom wall part. This sludge often initially has a consistency similar to clay, and during initial drying and working, the material may have a consistency more closely resembling peanut butter, until the material is more thoroughly dried to more closely resemble a granular material. Because of these properties, the material has a tendency to stick or adhere to the sidewall of the drying chamber, and for this reason the blades of the rotary auger 51' must rotate close to and hence effectively scrape the material from the surface of the arcuate wall. The natural rotation of the auger (counterclockwise in FIG. 6) causes the material to assume a profile substantially as illustrated by the dotted line 80' in FIG. 6. That is, the level of the material in the drying chamber falls significantly below the horizontal plane 35' on the side of the rotor which is moving downwardly, and conversely some of the material tends to accumulate above the rotor adjacent the sidewall 32' on the side of the rotor which is moving upwardly, thereby accumulating a mass of material 81' which is disposed outside the rotational path of the auger. While a system of the type described above and diagrammatically illustrated by FIG. 6 is commonly utilized and has been believed to operate in a satisfactory manner, nevertheless evaluation of this prior art system reveals that the structural and functional relationships are less than optimum.

More specifically, in evaluating batch-type dryers of this type, it is believed that the most effective heat transfer and hence efficient drying of sludge occurs due to the heat which is transmitted directly through the arcuate bottom wall part 29' so as to effect direct heating of the material which contacts the inside of this wall, but at the same time this heated material must be continuously scraped away from the wall and agitated so as to not only permit more uniform and efficient heating of the entire mass of material, but to also prevent "baking" of the material unto the wall. With this prior art arrangement of FIG. 6, however, the material tends to assume a profile similar to and anywhere in the range between that approximated by the lines 80' and 80''. That is, the material on one side of the rotor drops below the plane 35' by anywhere from a minimum angle of about 15° to a maximum angle which approaches about 90°. Thus, the effective heat transfer area over the bottom arcuate wall 29' is reduced by a significant extent which may be up to at least 45° and as much as 85° of the overall 180° extent of this bottom wall. At the same time, the mass 81' or 81'' of material which collects above the rotor cannot be as effectively heated and dried since this mass 81' or 81'' tends to strongly adhere or stick to the sidewall 32' and does not readily fall back into the rotor, whereby it thus is not properly mixed and dried with the same degree of efficiency as the material located within the rotor profile. Further, some prior art dryers of this type do not heat the vertical sidewalls so that very little drying of the material in the mass 81' or 81'' occurs. While other prior art dryers extend the heat exchanger upwardly so as to heat these sidewalls, then such heating can have a detrimental effect since the mass 81' or 81'' tends to securely adhere to this sidewall and this often results in overheating and hence baking of the outer layer of the material which directly adheres to the sidewall. This large mass 81' or 81'', whether disposed adjacent a heated or nonheated sidewall, is detrimental to the overall drying efficiency.

Accordingly, the improved dryer of the present invention is designed to improve upon and significantly overcome the aforementioned disadvantages.

In the dryer of this invention, the drying chamber is defined by a sidewall having the same general configuration as the prior art except that the complete chamber is oriented so that its upwardly-opening direction is inclined at a substantial angle to the vertical. This results in both the 180° arcuate bottom wall having its top plane disposed at a predetermined angle relative to the horizontal, and the upwardly projecting parallel sidewalls also extending at this same predetermined angle relative to the vertical. The rotor is rotated in a direction such that the side thereof having upward motion is located above the horizontal plane, and the rotor side having downward motion is located below the horizontal plane. Hence, after filling the rotor about one-half full with material, the rotor rotation causes the material to assume a sloped orientation similar to that in a conventional prior art dryer, but this sloped orientation is such that the bottom arcuate portion still remains substantially full of material. Effective heat transfer thus occurs throughout substantially the complete 180° bottom arcuate wall, thereby significantly increasing the overall heating and drying efficiency. At the same time, the mass of material which accumulates above the output side of the rotor is itself normally of significantly less quantity since it is accumulating beneath the upwardly sloped sidewall and more directly overlies the center of the rotor. These factors, coupled with the slope of the sidewall, tends to minimize the adherence of the mass to the sidewall and thus facilitates the return of this material back into the rotor. This also increases the overall heat transfer and drying efficiency.

With this improved dryer, as briefly explained above, the opening defined at the upper edges of the sidewall is also disposed within a plane which slopes downwardly from the horizontal at said predetermined angle, whereby this facilitates sideward loading of the drying chamber, either manually or by means of a fork lift or other suitable equipment.

Other objects and purposes of the present invention will be apparent to permit persons familiar with structures of this general type upon reading the following specification and inspecting the accompanying drawings.

Figure 1:
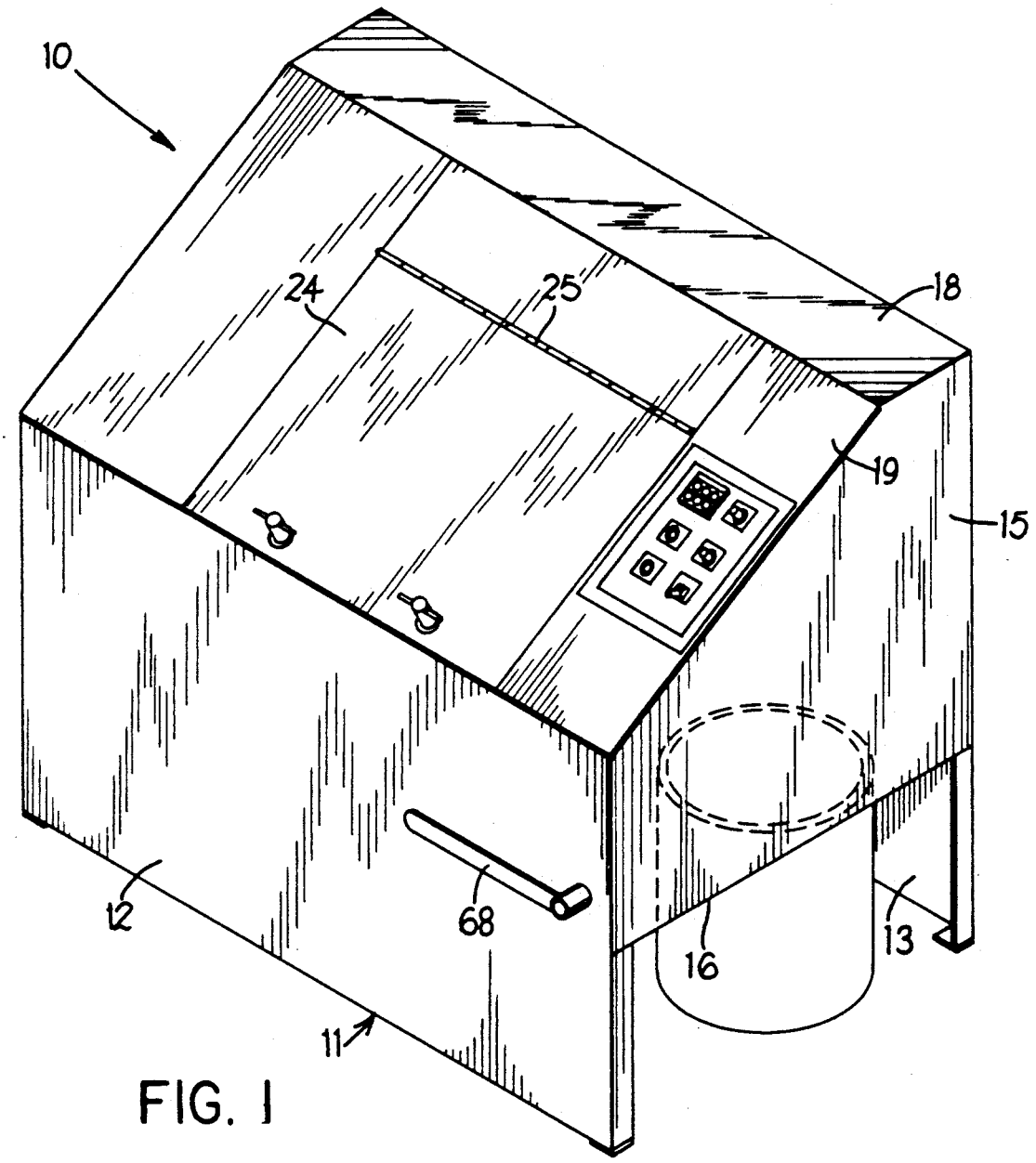
FIG. 1 is a perspective view of the improved dryer according to the present invention.

Certain terminology will be used in the following description for convenience in reference only, and will not be limiting. For example, the words "upwardly," "downwardly," "rightwardly" and "leftwardly" will refer to directions in the drawings to which reference is made. The words "inwardly" and "outwardly" will refer to directions toward and away, respectively, the geometric center of the apparatus and designated parts thereof. Said terminology will include the words specifically mentioned, derivative thereof, and words of similar import.

DETAILED DESCRIPTION

Referring to the drawings, there is illustrated a batch-type dryer 10 of the present invention. The dryer includes an outer housing or cabinet 11 which is of a somewhat box-like configuration and includes generally parallel front and back walls 12 and 13, respectively, rigidly joined together by generally parallel end walls 14 and 15. The end wall 15 has a large opening 16 formed in the bottom portion thereof for accommodating a removable receptacle 17, as explained hereinafter. The housing also includes a generally horizontal top wall 18 of small extent, the latter being joined to the front wall through a generally sloped cabinet wall 19.

A chamber structure 21 is fixed to and disposed within the housing so as to define a generally channel-like drying chamber 22. This drying chamber 22 is accessible through an access opening 23 which is formed in the sloped exterior wall 19. The access opening 23, which is used for depositing sludge or material to be dried into the chamber 22, is suitably closed by a cover 24, the latter being joined to the sloped wall 19 by a suitable hinge 25 which extends along the upper edge of the cover. Suitable lockable handles are preferably associated with the lower edge of the cover to permit it to be locked in the closed position. The closing action of the cover 24 engages a limit-switch (not shown) permitting the drive motor and heating means to be engaged. Conversely when the cover means 24 is open, the heating and drive means are disabled.

The chamber structure 21 is defined by a generally channel or U-shaped sidewall 26 which extends in the elongated direction of the housing and is closed at opposite ends by end panels 27 and 28. These elements 26–28 cooperate to define the drying chamber 22 therein, with this chamber being accessible through the top opening 23.

The U-shaped sidewall 26 has an arcuate bottom wall part 29 which is of a generally cylindrical configuration generated on a radius about the horizontal axis 31 which extends longitudinally of the housing in generally perpendicular relationship to the housing end walls 14 and 15. This arcuate bottom wall part 29, however, is generated so as to extend about the axis 31 only through an angle of about 180°, at which point the edges of this arcuate bottom wall part rigidly, here integrally, join to generally parallel straight wall parts 32 and 33, the latter at their upper edges being rigidly joined to the sloped wall 19. The arcuate bottom wall part 29, due to its angular extent of 180°, is disposed in its entirety below a diametrical plane 34 which contains and passes through the axis 31. This diametrical plane 34 in turn is tilted or pivoted about the axis 31 so as to slope or extend at a predetermined angle $\beta$ relative to a horizontal plane 35 which contains and passes through the axis 31. This angle $\beta$ may be in the range of from about 20° to about 45°, but is preferably 30°±about 5°.

The chamber structure 21 has a heat device and in the disclosed embodiment a heating jacket 41 disposed so as to externally surround at least part of the U-shaped sidewall 26. This heating jacket 41, in the illustrated and preferred embodiment, defines an interior passage 42 which is designed to receive a heating fluid, preferably steam. This heating jacket 41 preferably extends the complete axial length of the sidewall 26, and also extends arcuately throughout the full angular extent of the arcuate bottom wall part 29. A suitable inlet 43 and outlet 44 are provided for permitting steam to be supplied to and discharged from the jacket, with this inlet and outlet being connected by conduits (not shown) to an external source of steam. If preferred or desired, the heating jacket 41 can be provided with extensions 45 which extend externally upwardly along one or both of the sidewalls 32 and 33. The heating jacket 41 is conventional, and numerous other variations of heating jackets can be utilized, such as an electrical heating type.

The heating chamber 22 has a rotor or agitator 51 disposed therein for agitating the material to facilitate heating and drying thereof. This agitator 51 has an elongate central shaft 52 which extends along the axis 31 and projects outwardly through the end panels 27 and 28 so as to be rotatably supported by conventional bearings 53. The shaft 52 extends through packing glands 78 that are replaceable and adjustable and effectively seal the interior of the chamber from the outside. The agitator 51, in the illustrated embodiment, includes radially outer and inner blades 54 and 55, respectively. The outer blades 54 are of an outer radius similar to the inside surface of the bottom arcuate wall 29 and hence are positioned so that they rotatably slide across the inside surface of this wall in closely adjacent relationship to effectively scrape or wipe the sludge from the wall. The outer blades 54 may consist of several individual arcuate blade segments, or may consist of a single elongated spiral-like blade which in effect defines a continuous auger. This outer blade arrangement, whether formed by one continuous or several segmented blades, defines an outer auger arrangement which spirals axially from one end of the drying chamber toward the other. The radially inner blades 55, on the other hand, normally consist of several blades of arcuate extent which also define an auger-like arrangement except that they spirally are of opposite hand from the outer blades to effectively move the material centrally along the chamber in the opposite axial direction. The blades are joined to the shaft 52 by radial arms or spokes 56. Bolt on auger segments 79 are preferably radially adjustable to enable the outer blades to be positioned as closely adjacent the inside surface of the arcuate bottom wall as is desirable for optimum performance. The overall structure of the agitator 51 is generally conventional and is known as a ribbon-type rotor.

Agitator 51 is rotatably driven from a drive motor 57 which is disposed within the housing in the illustrated embodiment. This drive motor preferably drives a speed reducer 58, and the latter in turn drives the agitator shaft 52 through a suitable but conventional chain drive 59. The speed ratios are preferably selected so that the agitator rotates at a rather slow speed, such as about 12 revolutions per minute.

An inlet opening 61 in panel 28 communicates with the chamber 22 to enable atmospheric air to be sucked therein. An outlet 62 also communicates with the chamber, which outlet is preferably connected through a duct 63 to a suction pump or like device for sucking the moisture-laden heated air out of the chamber 22. This is also conventional.

Figure 2:
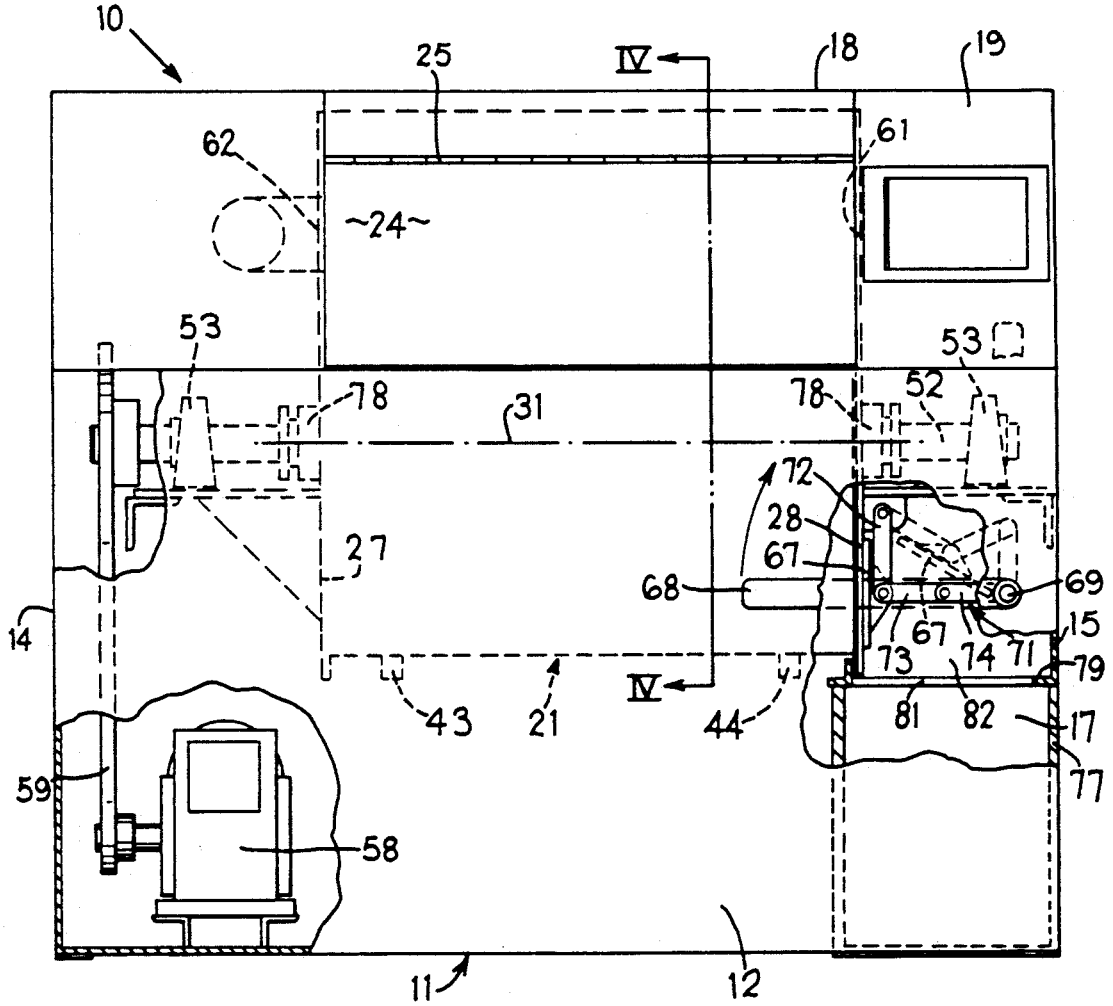
FIG. 2 is a front elevational view, partially broken away, illustrating the dryer.

To permit discharge of dried material from the chamber 22, the end panel 28 has a discharge opening 66 formed therein, which opening communicates with the lowermost portion of the chamber 22. A door 67 is provided for controlling the opening and closing of the discharge opening 66. The movement of the door 67 is manually controlled by a lever or handle 68 which is disposed externally adjacent the front wall of the cabinet. This handle 68 is connected to a rotary shaft 69 which projects horizontally into the interior of the housing for controlling movement of a linkage 71 which connects to the door 67. This linkage 71 is of a toggle type and includes a first link or lever 72 which is pivoted at its upper end to the housing and pivoted at its other end to the door 67. A first toggle link 73 has one end thereof pivotally joined to the door 67 (or link 72) and its other end pivotally joined to one end of a second toggle link 74, which link 74 at its other end is nonrotatably coupled to the shaft 69. The rotary back-and-forth manual actuation of handle 68, acting through the linkage 71, moves the door 67 between the closed position illustrated by solid lines in FIG. 2, and the opened position indicated by dotted lines in FIG. 2.

OPERATION

The operation of dryer 10 will be briefly described to ensure a complete understanding thereof.

The dryer 10 initially has a batch of sludge deposited therein through the top access opening 23. For this purpose, the cover 24 is swung upwardly about hinge 25 so that a predetermined quantity of material can be deposited into chamber 22. The cover limit switch precludes the machine running when the cover is open. The quantity of material is normally sufficient to fill the chamber 22 up to about the horizontal plane 35. Since the access opening 22 is also disposed in a plane which slopes downwardly and is generally parallel with the diametrical plane 34, this facilitates loading of material from the front side, such as manual loading, by minimizing the amount of lifting required to deposit the material in the drying chamber 22. This is evidenced by the fact that the upper edge of the front or lower sidewall 33 is at an elevational below the uppermost point of the rotor 51.

Figure 3:
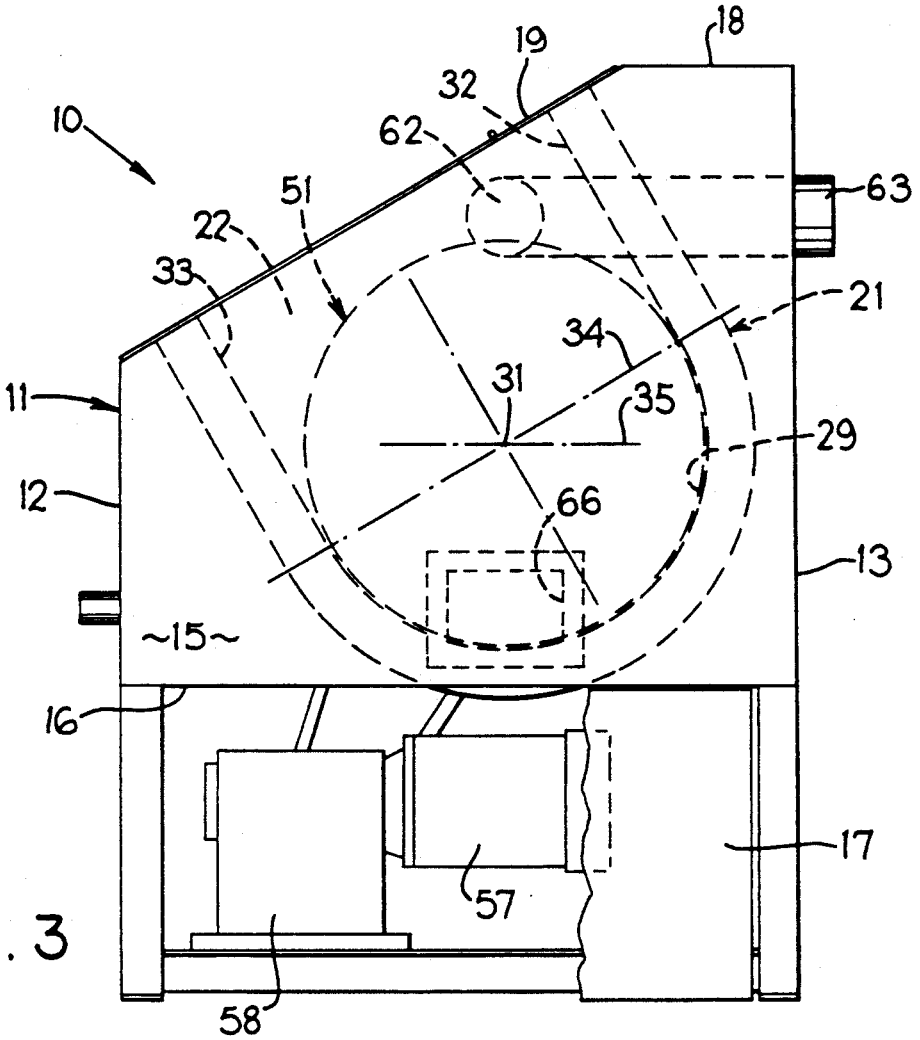
FIG. 3 is an end elevational view of the dryer.
Figure 4:
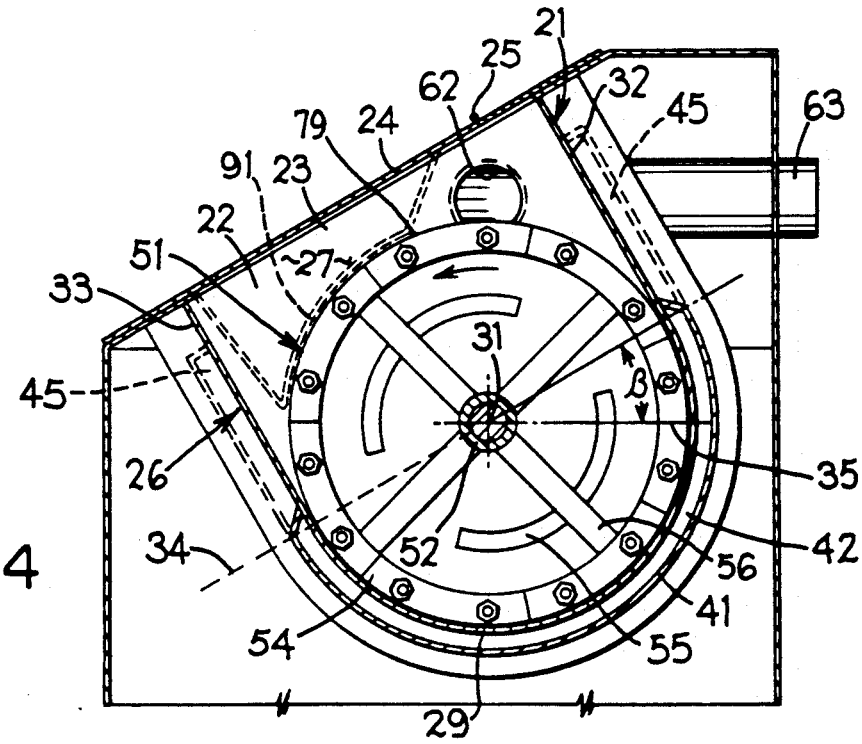
FIG. 4 is a fragmentary sectional view taken substantially along line IV—IV in FIG. 2.
Figure 5:
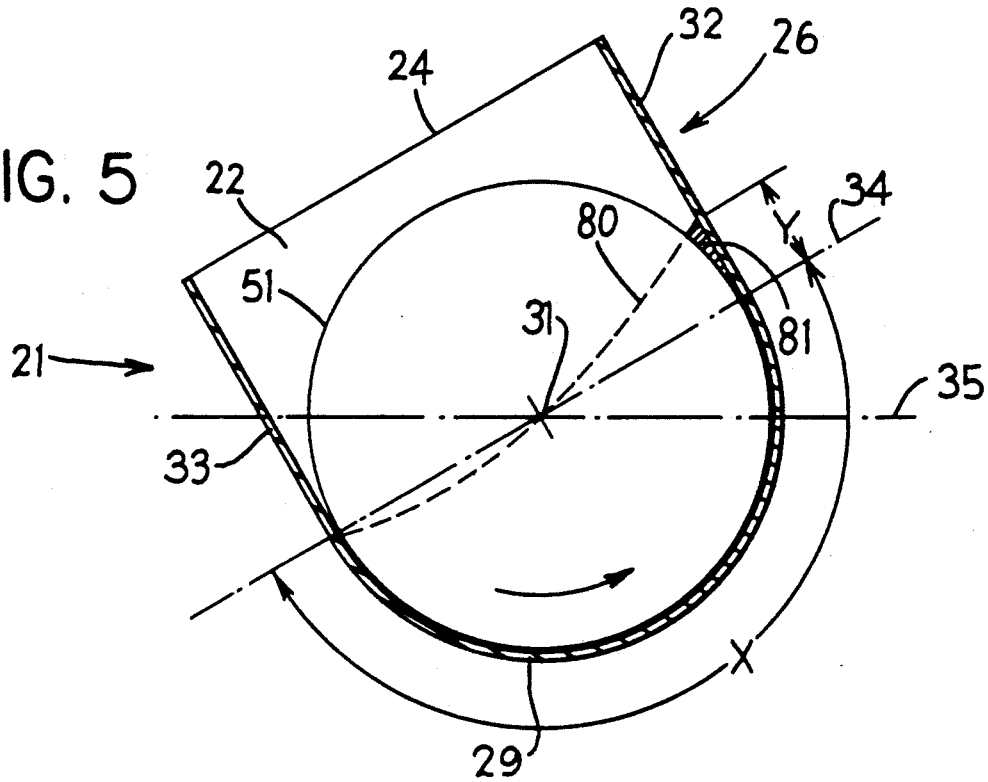
FIG. 5 diagrammatically illustrates the vertical cross sectional arrangement of the drying chamber of the present invention.

After the chamber has been loaded with sludge and the cover closed, steam is supplied to the jacket 41, air is sucked into and out of the chamber, and rotor 51 is slowly rotated in the counterclockwise direction as illustrated by FIGS. 3–5. This rotation of the agitator 51 causes the material to assume a new position wherein the material is generally sloped upwardly across the agitator so as to assume a profile similar to that outlined by the dotted line 80 in FIG. 5. The slope of the material on the input side of the rotor (the leftward side in FIG. 5) is normally 20° to 30° below the horizontal plane (although in some cases the slope can be greater than this), and under most circumstances the sludge material will remain in intimate contact with the arcuate bottom wall 29 throughout the full 180° arcuate extent thereof, even though the material assumes the sloped position indicated by line 80. The angular tilting of the arcuate bottom wall 29 compensates for the slope assumed by the material during rotation of the agitator 51, and thus effected heat transfer can occur throughout substantially the entire 180° arcuate extent of the wall 29, this being indicated by the arcuate extent X in FIG. 5.

Figure 6:
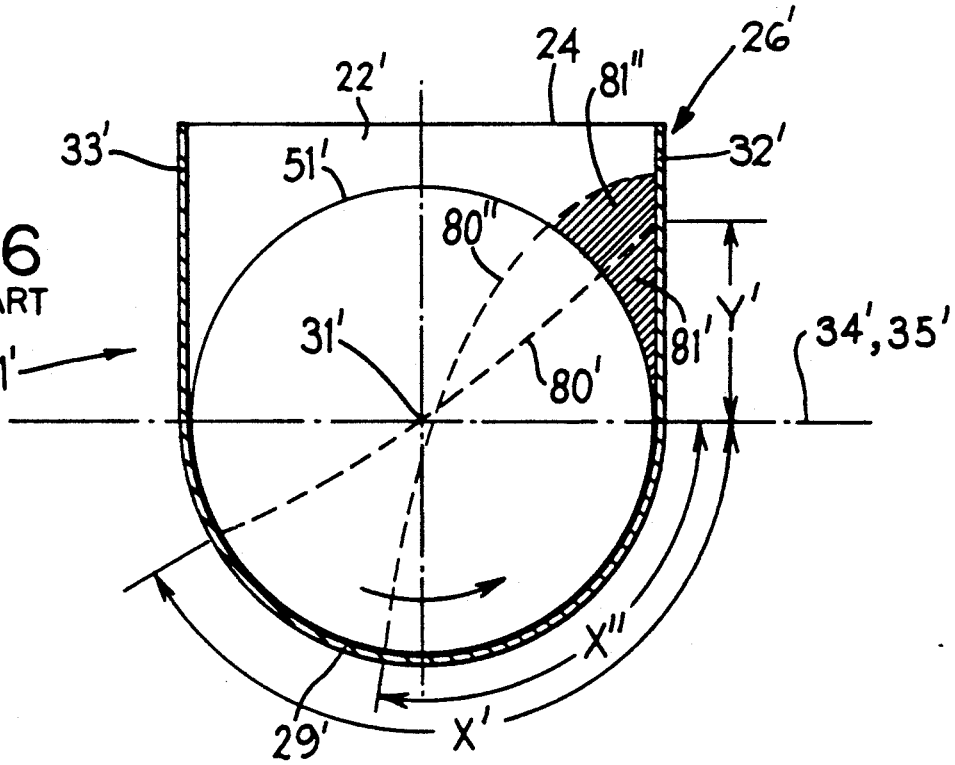
FIG. 6 PRIOR ART
FIG. 6 is a diagrammatic illustration similar to FIG. 5 but illustrating the prior art.

In contrast, with the prior art device illustrated by FIG. 6, the slope 80' to 80'' assumed by the material due to rotation of the agitator 51' causes the material to remain in contact with the arcuate bottom wall 29 only through the arcuate extent designated X' to X'', which extent is significantly less than 180° so that there is less effective heat transfer area.

Further, with the operation of the improved dryer of the present invention as diagrammatically illustrated in FIG. 5, the material which tends to collect above the rotor at the outlet side, namely the mass of material designated 81, is of smaller amount than the mass 81' or 81'' associated with the prior art device illustrated in FIG. 6. This is due to the geometry inasmuch as the sloped upper sidewall 32, coupled with the slope of the material as designated by the line 80, hence reduces the mass of the material 81. Further, since this sloped wall 32 does not extend vertically as does the wall 32', but rather is sloped so as to partially function as a top wall for the mass 81, this tends to minimize the adhesion in that gravity is more effective in breaking the material away from the wall so as to permit the material to more readily fall downwardly into the profile of the rotor to permit agitating and mixing of the material and thus prevent undesirable "baking" of the material.

The improved dryer of the present invention is particularly desirable for use on heavy wet sludge such as metal hydroxide and paint sludge. However, it will be appreciated that this dryer will also provide improved performance when used with numerous other materials, particularly materials having a wet and sticky nature.

After the material has been suitably dried, then the door 67 is manually opened so as to uncover the discharge opening 66, whereupon continued rotation of the agitator 51 causes the dried material to be moved axially along the drying chamber so as to be discharged outwardly through opening 66 for deposit into the receptacle 17. The receptacle 17 preferably is of a box-like structure having an open top 76 for deposit of material therein. This receptacle 17 is sized so that it can be moved sidewardly into the housing through the end opening 16 for disposition directly under the discharge opening 66. The sizing of the receptacle is preferably selected such that the receptacle has a front wall 77 which is adapted to substantially totally occupy the opening 16 and be substantially flush with the end wall 15. In addition, the top edge of receptacle 17 substantially sealingly engages the lower horizontal surface of plate 79 which is fixed to the housing. This plate 79 has an opening 81 therethrough for communication with an interior housing chamber 82, which chamber communicates with the discharge opening 66 and the inlet opening 61. In this manner, when the discharge opening 66 is opened so as to permit material discharge into the receptacle, the dust generated during the discharge is effectively contained within the housing and cannot readily escape into the surrounding environment due to the mechanical configuration and the negative pressure created by the opening 61 in panel 28. If necessary or desirable, suitable flexible sealing flaps or strips can be provided around the edge of the opening 16.

When the improved dryer of this invention is used with certain materials, specifically metal hydroxide sludge, experimental testing indicates that the sludge undergoes many different viscous conditions during the drying cycle and, during one of these conditions the sludge has a consistency similar to that of peanut butter. During such condition, it has been observed that the sludge may tend to build up in the region adjacent the sloped front wall 33 outwardly from the rotor 51. For such materials, the heating jacket 41 is preferably provided with extensions 45 as indicated by dotted lines in FIG. 4, at least along the sloped front wall 33, to thus accelerate the drying of the material which tends to build up in the region adjacent this wall 33. This material which builds up in this region does dry sufficiently that it will ultimately fall downwardly into the rotor 51 so as to be agitated by the rotor and so as to permit completion of the drying cycle.

As an alternative, however, the cover 25 of the apparatus may be provided with a deflector 91 thereon as indicated by dotted lines in FIG. 4. Such deflector 91 is preferably of a hollow shell-like configuration which extends the longitudinal length of the cover, and projects downwardly therefrom into the chamber 27 so that the deflector has a bottom wall which closely conforms with the outer periphery of the rotor 51 and effectively occupies the region outside the rotor but adjacent the front wall 33, thereby tending to prevent the buildup of material in this region.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a batch-type dryer, comprising a housing having a chamber structure fixed thereto and defining a channel-like drying chamber, said chamber structure including a generally horizontally elongated U-shaped sidewall extending between and fixedly connected to a pair of end walls and defining therein an upwardly-opening drying chamber, said U-shaped sidewall including an arcuate bottom wall part which is of uniform radius generated about a substantially horizontal axis, said arcuate bottom wall part extending through an angle of about 180° and being disposed entirely below a diametrical plane which contains said axis, said U-shaped sidewall also including generally parallel first and second sidewall parts which are joined to side edges of said arcuate bottom wall part and which project upwardly away from said diametrical plane in generally perpendicular relationship thereto, said sidewall parts having upper edges which define an opening therebetween for depositing material into said chamber, cover means movable mounted on said housing for closing off said opening, rotor means disposed within said chamber for rotation substantially about said axis to agitate the material within said chamber, and a heat means associated with at least said arcuate bottom wall part, the improvement wherein said housing includes wall means cooperating with one said end wall for defining a closed interior compartment, said one end wall having a discharge opening therein for permitting communication between said interior compartment and said drying chamber at a lowermost point therein, door means movably mounted relative to said chamber structure for selectively opening and closing said discharge opening, said wall means including a bottom wall having opening means therethrough for permitting discharge of dried material downwardly therethrough through when said door means is opened, and upwardly-opening receptacle means removably positioned beneath the opening means in said bottom wall for receiving the dried material, said receptacle means having a top edge which is disposed in substantial sealing engagement with said bottom wall for confining dust within said interior compartment.

2. A dryer according to claim 1, wherein said opening is disposed in a plane which is substantially parallel with said diametrical plane.

3. A dryer according to claim 2, wherein said angle is about 30°.

4. A dryer according to claim 1, wherein said heat means extends solely around said arcuate bottom wall part.

5. A dryer according to claim 1, wherein said second sidewall part projects upwardly from the other side of said diameterical plane which is inclined above said horizontal plane, and wherein said heat means extends around the arcuate bottom wall part and also upwardly along at least said second sidewall part.

6. A dryer according to claim 1, wherein said cover means comprises a hinged door which, when in a closed position, extends across said opening within a plane substantially parallel to said diametrical plane for closing off said opening.

7. A dryer according to claim 1, including suction means connected to said interior compartment.

8. A dryer according to claim 7, wherein said suction means includes an opening formed in said one end wall for providing communication between said interior compartment and said drying chamber, and a suction conduit connected to said drying chamber in the vicinity of the other said end wall.

9. A dryer according to claim 8, wherein said diametrical plane is inclined at a predetermined angle in the range of about 20° to about 45° relative to a horizontal plane passing through said axis so that said diametrical plane on one side of said axis corresponding to downward rotary movement of said rotor is disposed below the horizontal plane.

10. In a batch-type dryer for drying sludgelike material, comprising a housing having a chamber structure fixed thereto and defining a channel-like drying chamber, said chamber structure including a generally horizontally elongated U-shaped sidewall extending between and fixedly connected to a pair of end walls and defining therein an upwardly-opening drying chamber, said U-shaped sidewall including an arcuate bottom wall part which is of uniform radius generated about a substantially horizontal axis, said arcuate bottom wall part extending through an angle of about 180° and being disposed entirely below a diametrical plane which contains said axis, said U-shaped sidewall also including generally parallel first and second sidewall parts which are joined to side edges of said arcuate bottom wall part and which project upwardly away from said diametrical plane in generally perpendicular relationship thereto, said sidewall parts having upper edges which define an opening therebetween for depositing material into said chamber, cover means movable mounted on said housing for closing off said opening, rotor means disposed within said chamber for rotation substantially about said axis to agitate the material within said chamber, and a heat means associated with at least said arcuate bottom wall part, the improvement wherein a discharge opening is formed in one said end wall for communication with said drying chamber at a lowermost point therein, door means movably mounted relative to said chamber structure for selectively opening and closing said discharge opening, said housing including wall means defining a substantially closed cabinet having said chamber disposed therein, said wall means including an outside wall which is spaced from said one end wall, said outside wall having opening means therethrough, an upwardly-opening receptacle means removable positioned through said opening means into said cabinet beneath said discharge opening for receiving the dried material, said receptacle means having a wall which substantially closes off said opening means when said receptacle means is positioned below said discharge opening for confining dust within said closed cabinet.

11. A dryer according to claim 10, including suction means for removing dust from the interior of the closed cabinet and from the drying chamber, said suction means including an opening formed in said one end wall for providing communication between the interior of the closed cabinet and the drying chamber, and a suction conduit connected to said drying chamber in the vicinity of the other said end wall.

12. A dryer according to claim 10, wherein said diametral plane is inclined at a free determined angle relative to a horizontal plane passing through said axis so that said diametral plane, on one side of said axis corresponding to downward rotary movement of said rotor means, is disposed below the horizontal plane, said predetermined angle being in the range of about 20° to about 45°.

13. A dryer according to claim 1, wherein said diametral plane is inclined at a predetermined angle relative to a horizontal plane passing through said axis so that said diametral plane, on one side of said axis corresponding to downward rotary movement of said rotor means, is disposed below the horizontal plane, said predetermined angle being in the range of about 20° to about 45°.

14. A dryer according to claim 13, including suction means connected to said interior compartment.

* * * * *

UNITED STATES PATENT AND TRADEMARK OFFICE

CERTIFICATE OF CORRECTION

PATENT NO. : 5 172 492

DATED : December 22, 1992

INVENTOR(S) : Thomas W. PETERSON et al

It is certified that error appears in the above-identified patent and that said Letters Patent is hereby corrected as shown below:

Column 8, line 17; change "movable" to ---movably---.
line 32; delete "through".

Column 9, line 25; change "movable" to ---movably---.

Column 10, lines 3 and 4; change "removable" to ---removably---.

Signed and Sealed this

Twenty-eighth Day of December, 1993

Bruce Lehman

*Attest:*

BRUCE LEHMAN

*Attesting Officer*

*Commissioner of Patents and Trademarks*